United States Patent [19]

Hollingsworth

[11] 4,155,404

[45] May 22, 1979

[54] METHOD FOR TENSIONING CASING IN THERMAL WELLS

[75] Inventor: Frank H. Hollingsworth, Tulsa, Okla.

[73] Assignee: Standard Oil Company (Indiana), Chicago, Ill.

[21] Appl. No.: 880,261

[22] Filed: Feb. 22, 1978

[51] Int. Cl.[2] ..... E21B 33/127; E21B 33/14

[52] U.S. Cl. ..... 166/285; 166/187; 166/242

[58] Field of Search ..... 166/285, 242, 212, 187

[56] References Cited

U.S. PATENT DOCUMENTS

| | | | |
|---|---|---|---|
| 2,207,345 | 7/1940 | Hammer | 166/285 |
| 2,609,881 | 9/1952 | Warren | 166/285 |
| 2,970,651 | 2/1961 | Roberts | 166/212 |
| 3,055,424 | 9/1962 | Allen | 166/242 X |
| 3,085,627 | 4/1963 | Sodich | 166/212 X |
| 3,578,083 | 5/1971 | Anderson et al. | 166/285 |
| 3,777,819 | 12/1973 | Delano | 166/285 |
| 3,918,522 | 11/1975 | Suman, Jr. | 166/285 |
| 3,976,139 | 8/1976 | Wilder | 166/285 |

OTHER PUBLICATIONS

Uren, L. C., *Petroleum Production Engineering, Oil Field Development*, McGraw-Hill Pub. Co., N.Y., N.Y., 1956, pp. 511–519.

*Primary Examiner*—Stephen J. Novosad
*Attorney, Agent, or Firm*—Fred E. Hook

[57] ABSTRACT

A simplified method for tensioning casing in thermal wells involving the use of an inflatable packer element. The packer element is positioned at or near the bottom of a casing string and is inflated with cement after the cement annulus has been filled with cement. The packer is used to anchor the bottom of the casing while tension is applied to the top of the casing during the setting of the cement. After the cement has set the packer is a permanently imbedded in the casing cement.

2 Claims, 3 Drawing Figures

METHOD FOR TENSIONING CASING IN THERMAL WELLS

BACKGROUND OF THE INVENTION

This invention relates to a method for cementing a casing in a wellbore in which the casing will subsequently be heated to a high temperature, and more particularly to a method for anchoring the lower end of the casing while upward tension is applied to the casing while cement is allowed to set.

Prior art, which is believed to be relevant to the present invention, includes U.S. Pat. No. 3,976,139, issued to L. B. Wilder on Aug. 24, 1976, and assigned to the assignee of the present invention. Discussed in this patent are the problems encountered in thermal wells in which heating of the casing can cause buckling and joint failure. This is due to the fact that in normal cementing operations the tension applied to the casing is merely that occurring due to its own weight. This tension has been found to be insufficient to prevent the casing from being placed in a condition of compression at high temperatures which are often encountered. As discussed in the patent, such problems can be overcome by anchoring the bottom of the casing during the cementing operation and applying extra tension to the casing while the cement sets. The patent discusses prior art mechanical anchors which have been used and discloses an improved anchor. The disclosed anchor has a number of steel arms which are extended from the casing after cement has been circulated through the annulus and engage the borehole wall to resist upward movement of the casing. As noted at column 4, lines 44–47, of that patent, the anchors tend to plow through soft formations when they are encountered. It has been found in many cases that formations may be in fact so soft or the borehole is so irregular that the anchors will not provide sufficient resistance to movement to allow the desired level of extra tension to be applied. As a result, it has become standard practice to use fast-setting cement at the bottom of the borehole so that it may be used as an additional anchor while slower-setting cement in the upper parts of the borehole is still fluid as tension is placed on the casing.

It can be seen from an inspection of the prior art that these mechanical anchoring devices have been, in general, fairly complex. Even with such complexity, they have been found to not provide the desired anchoring in soft formations or irregular shaped boreholes.

Accordingly, an object of the present invention is to provide an improved and simplified method of extra tensioning a casing string during cementing operations.

Another object of the present invention is to provide a method of extra tensioning a casing string which is particularly effective in soft formations or irregular shaped boreholes.

These and other objects are achieved by using an inflatable casing packer at the bottom of the casing string as an anchor. Cement is pumped behind the casing in the normal manner prior to inflation of the packer. A cement wiper plug is then used to actuate the inflatable packer which is inflated with additional cement pumped in behind the wiper plug. After the packer is inflated with the desired pressure, extra tension is applied to the casing while the cement is allowed to cure.

DESCRIPTION OF THE PREFERRED EMBODIMENTS

Figure 1:
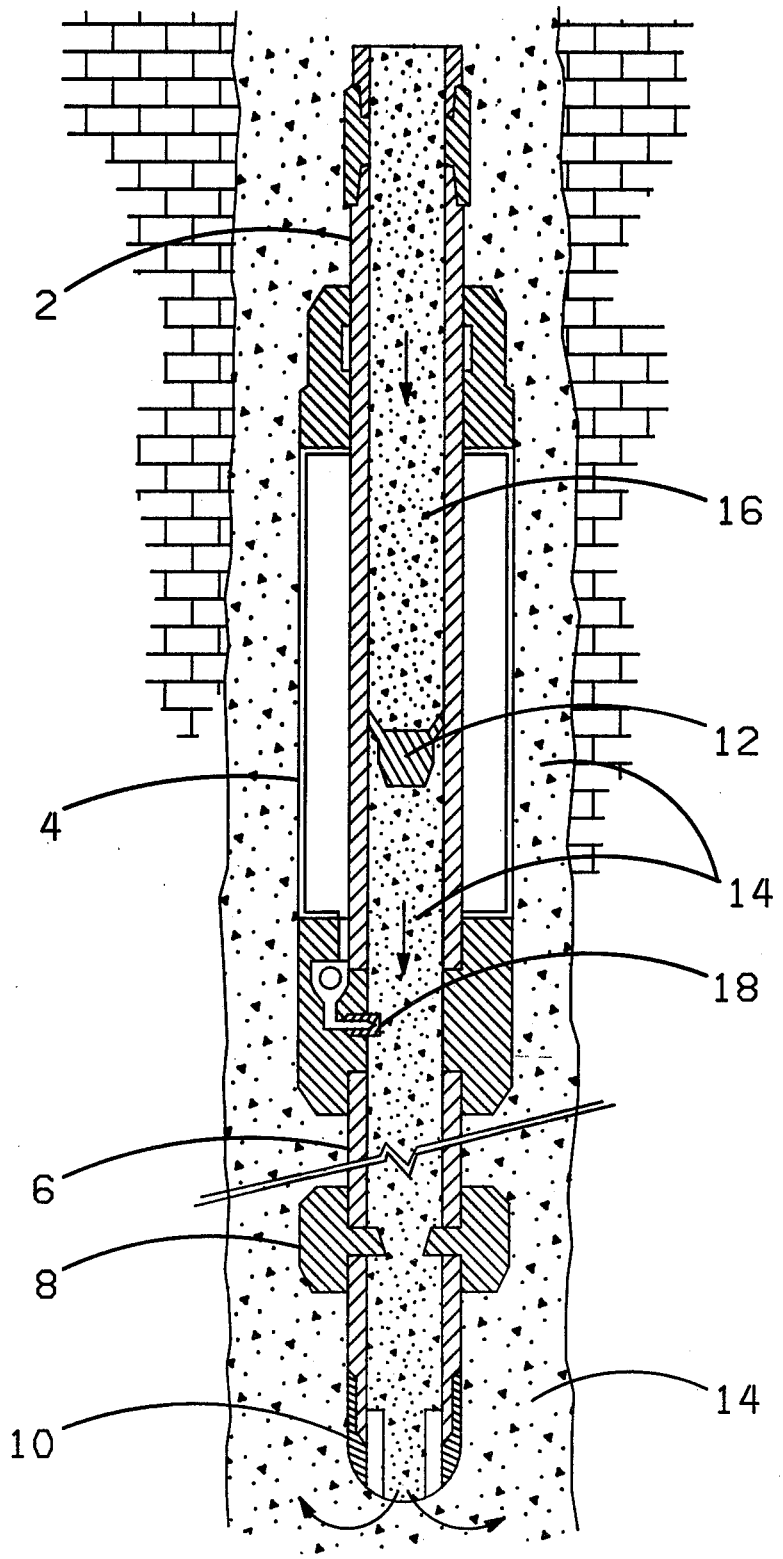
FIG. 1 is an illustration of a lower end of a casing with an external packer in place while cement is circulated down the casing and up the annulus surrounding the casing.

The method of completing the well according to the present invention is shown in the three figures. FIG. 1 illustrates the lower end of a casing 2 with an inflatable packer 4 positioned at essentially the lowest point on the casing. In the preferred embodiments the only elements below packer 4 are a short section of casing 6, a wiper plug seat 8, and a float shoe 10. Also illustrated in FIG. 1 is a wiper plug 12, which is typically used to follow cement 14, which is pumped down the casing to fill the annulus between the casing and the borehole. In the preferred embodiment, additional cement 16 is pumped down the casing behind wiper plug 12. During the pumping of cement into the annulus, the casing 2 is kept in motion relative to the borehole wall, since this has been found to greatly improve the integrity of the cementing job. Either a vertical reciprocation of the casing or a rotation of the casing 2 may be employed, depending upon the equipment available at the wellhead. Packer 4 does not interfere with either type of motion. The preferred packers are more specifically known as external casing packers and are sold by Lynes, Inc. of Houston, Tex., under the designation "Model RTS." These are commercially available in most standard casing sizes.

Figure 2:
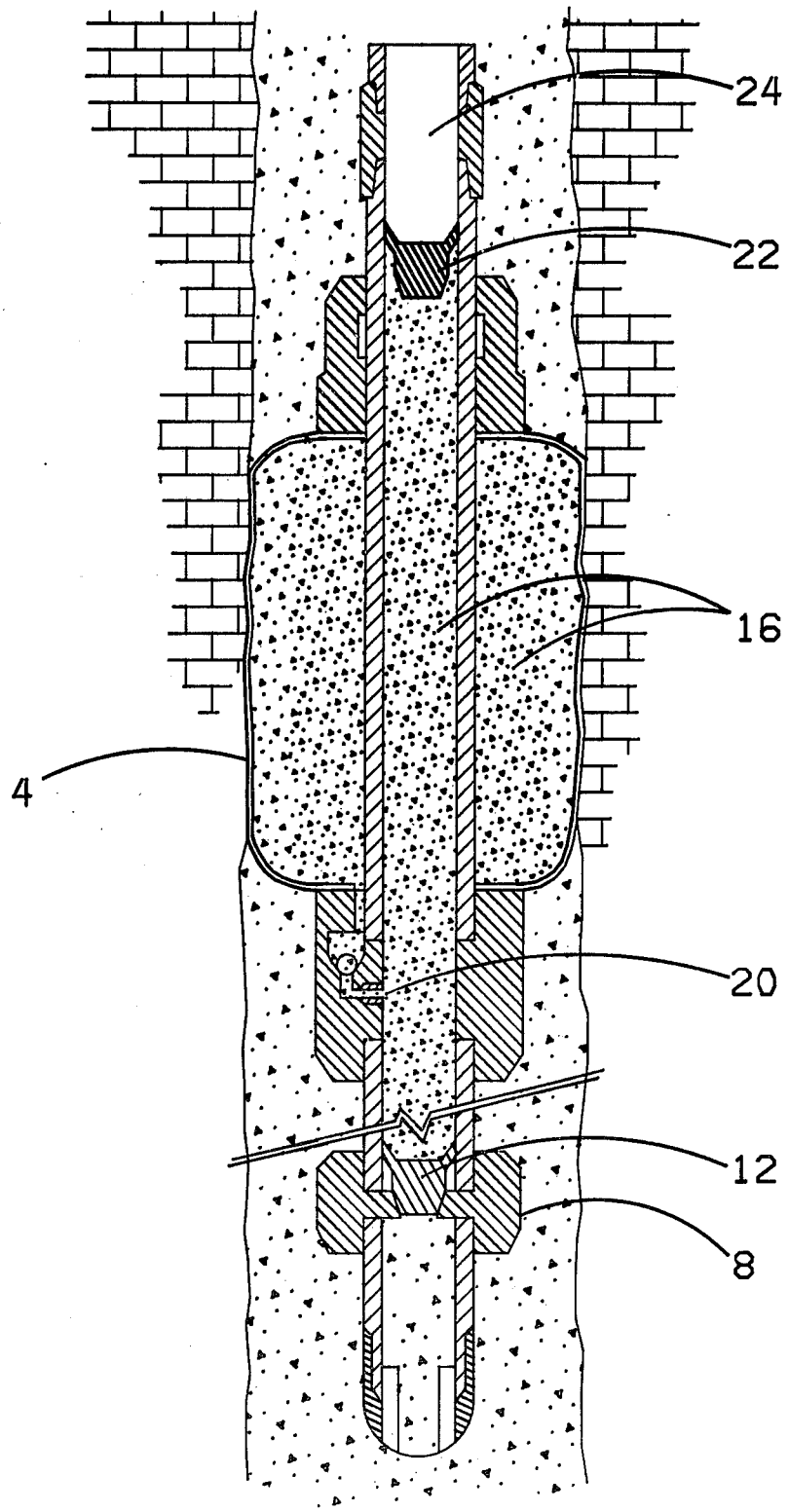
FIG. 2 is an illustration of the lower end of the casing after the annulus has been filled with cement and the packer has been inflated with cement.

FIG. 2 illustrates the condition of the casing after the annulus has been filled with cement and motion of the casing has ceased. The wiper plug 12 has sealed into seat 8 to prevent further flow of cement into the annulus. An input seal 18 (FIG. 1) to packer 4 has been broken off by wiper 12 when it passed through packer 4. The pressure inside the casing was then increased to cause cement 16 to flow through a valve 20 and inflate packer 4. An additional wiper plug 22 follows cement 16 to prevent contamination of cement 16 by a displacing fluid 24 which fills the casing above wiper plug 22. Wiper plug 22 is used in the preferred embodiment but is not essential if the displacing fluid is much lighter in specific gravity than the cement slurry so that cement contamination is minimized by gravity segregation. After the packer 4 has thus been pressurized and thereby expanded to grip the borehole wall, extra tension is applied to the casing at the wellhead and maintained during the setting period of the cement. Valve 20 includes a check valve which prevents back flow of inflating cement so that extra pressure does not need to be maintained in the casing while the cement sets.

If additional anchoring power is needed, a fast-setting tack cement may also be used in combination with the packer element as taught herein. But to avoid the complexities of the tack cement operation, it is preferred to simply use a longer inflatable element or a second packer positioned immediately above packer 4 or a packer with grit rings on its outer surface to increase the anchoring capacity.

It can be seen that the inflatable packer 4 has several advantages over a mechanical anchor such as that described in the above-referenced U.S. Pat. No. 3,976,139. As noted in that patent, the steel anchor bars tend to plow into a soft formation to obtain its anchoring effect; but in very soft formations the steel bars will simply continue to plow through the formation, damaging the borehole wall and filling the hole with loose debris. The steel bars do, in fact, act as plows and tend to dislodge the formation wall materials into the borehole. In contrast, the inflatable packer element 4 applies pressure normal to the borehole wall spread over a much larger surface area. Thus, the packer does not tend to pull the borehole wall materials into the hole nor to break up the borehole wall. Thus, it is seen that the inflatable packer is particularly suited for soft borehole materials, since it merely helps pack the borehole wall more tightly and as a result anchors more tightly to the borehole.

The inflatable packer also has advantages in irregular shaped boreholes which often occur in soft formations but may also occur in relatively hard formations. In such boreholes, steel anchor bars will not be loaded equally and some may not contact the borehole at all. In addition to reducing the anchoring effect, some of the bars may be bent or broken due to being overloaded. In contrast, an inflatable packer inflates to whatever shape the borehole has and anchors better when the borehole is irregular.

Figure 3:
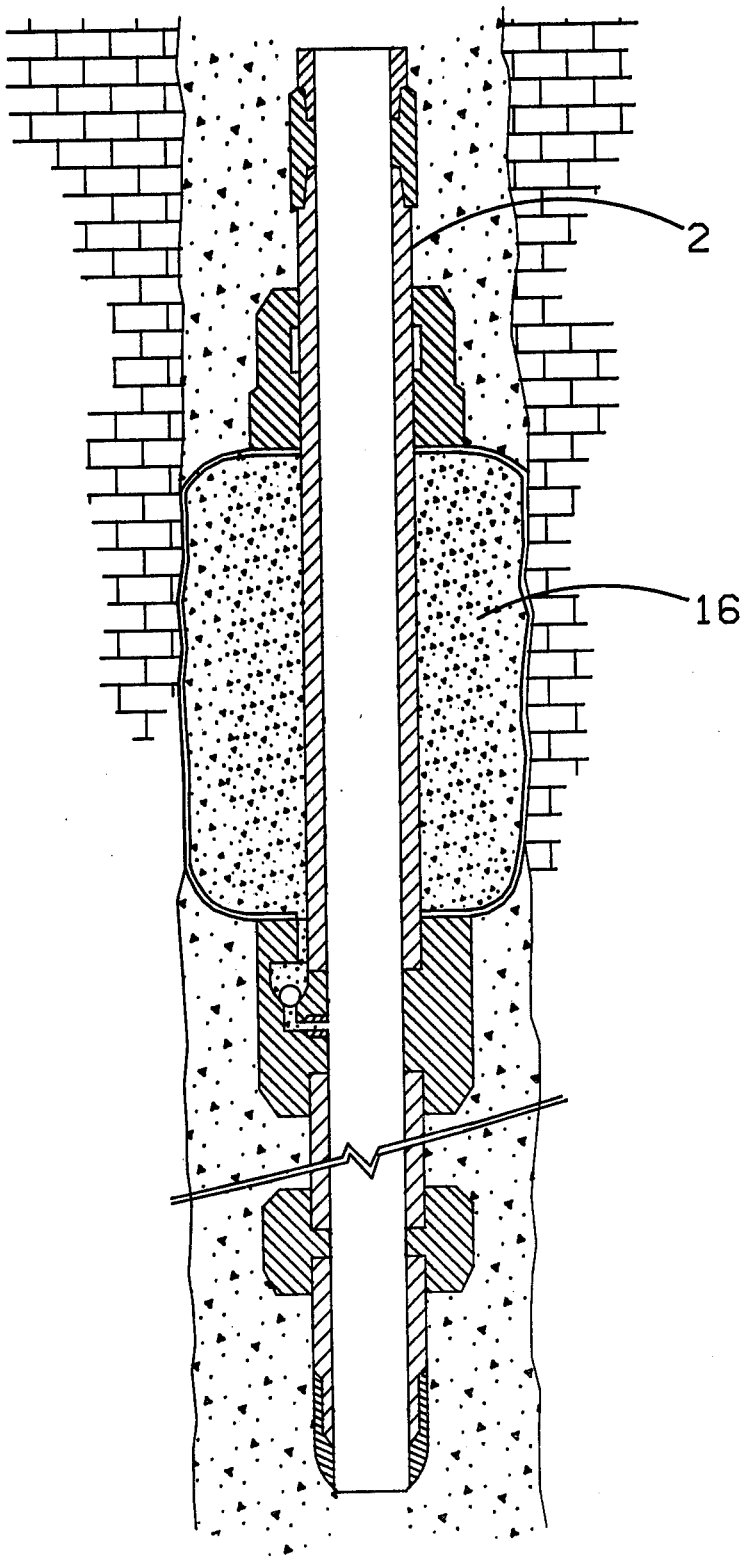
FIG. 3 illustrates the final completion after the cement has been drilled out of the casing.

FIG. 3 illustrates the final completion of the well according to the present invention. The cement which was left in the casing, to set therein, can be drilled out along with wiper plugs 22 and 12 to provide an open conduit to the very bottom of the casing and underlying formations if an open-hole completion is desired. It is apparent that more cement must be drilled out due to the quantity of cement left in the casing behind wiper plug 12, but this is a fairly simple matter. As an alternative, the inflatable packer anchor may be positioned below the objective formation and the casing may be perforated for access to the formation. If the anchor is set deeply enough to place plug 22 below the perforation depth, the drilling operation illustrated in FIG. 3 can be totally eliminated. It is also noted that in the final completion the packer 4 is filled with cement 16 so that it becomes a permanent part of the cement job. This is primarily due to the fact that the packer 4, being made mostly of rubber, could not withstand the normal operating temperatures in thermal wells and can be expected to disintegrate eventually. Since the packer is filled with cement, its disintegration will not leave any substantial void behind the casing.

Although the present invention has been illustrated in terms of particular steps and apparatus, it is apparent that other changes and modifications can be made within the scope of the present invention as defined by the appended claims.

I claim:

1. In a method of extra tensioning a string of casing to be cemented in a borehole so that said casing can withstand exposure to fluids flowing through the casing at a temperature greater than the initial temperature of said casing wherein cement is circulated down said casing and up the annulus between the casing and the borehole wall, while said casing is kept in motion relative to the borehole wall; after cement placement, the lower end of said casing is anchored to the borehole wall; and, tension is applied to the string of casing and maintained until the cement has set, the improvement comprising:

anchoring said casing to said borehole wall by:

attaching an inflatable packer to the lower end of said string;

circulating cement down through said inflatable packer and up the annulus between the packer and casing and the borehole wall; and after cement placement, inflating said packer to an anchoring position with cement.

2. An improved method according to claim 1 further including the step of, after the cement has set, drilling out cement which has set within the casing string.

* * * * *